US009552683B2

(12) United States Patent
Du et al.

(10) Patent No.: US 9,552,683 B2
(45) Date of Patent: Jan. 24, 2017

(54) CONTROLLING ACCESS TO A RESOURCE

(71) Applicant: KONINKLIJKE PHILIPS N.V., Eindhoven (NL)

(72) Inventors: Jia Du, Waalre (NL); Angelique Carin Johanna Maria Brosens-Kessels, Eindhoven (NL); Jonathan David Mason, Waalre (NL); Peter Bingley, Mierlo (NL); Paul Augustinus Peter Kaufholz, Eindhoven (NL); Azadeh Shirzad, Nieuwe Pekela (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 14/760,722

(22) PCT Filed: Jan. 30, 2014

(86) PCT No.: PCT/EP2014/051790

§ 371 (c)(1),
(2) Date: Jul. 14, 2015

(87) PCT Pub. No.: WO2014/124811

PCT Pub. Date: Aug. 21, 2014

(65) Prior Publication Data

US 2015/0356798 A1 Dec. 10, 2015

(30) Foreign Application Priority Data

Feb. 13, 2013 (EP) ..... 13155057

(51) Int. Cl.
*G07C 9/00* (2006.01)

(52) U.S. Cl.
CPC ..... *G07C 9/00134* (2013.01); *G07C 9/00031* (2013.01); *G07C 9/00* (2013.01)

(58) Field of Classification Search
CPC ... G07C 9/00031; G07C 9/00134; G07C 9/00; G07C 9/00158; G06F 21/00; G06F 21/31; G06F 2221/2129; G06F 17/30569; G06F 21/40; G06F 21/32; G06F 21/577; G06K 9/00; G06Q 20/04
(Continued)

(56) References Cited

U.S. PATENT DOCUMENTS 4,805,222 A 2/1989 Young et al.
6,714,778 B2 3/2004 Nykanen et al.
(Continued)

OTHER PUBLICATIONS

Shetty, P. et al. "Modelling Context-Aware Security for Electronic Health Records", Encyclopedia of Information Ethics and Security, 2007 Australia, DOI: 10.4018/978-1-59140-987-8.ch069.
(Continued)

*Primary Examiner* — Ali Neyzari

(57) ABSTRACT

A system is provided for controling access to a resource, the access being restricted by an access mechanism. The system comprises an access control subsystem for i) subjecting the user to one or more security measures based on use of a security input system, and ii) signaling the access mechanism to grant the user access to the resource based on the user passing the one or more security measures. The system further comprises a task interlace for accessing task data, the task data being indicative of a scheduled task of the user. The access control subsystem is further arranged for determining the one or more security measures based on the scheduled task to establish different levels of security depending on the task. Advantageously, a better adjusting of the level of security is obtained in that it is dynamically adjusted to the scheduled task of the user.

15 Claims, 2 Drawing Sheets

(58) Field of Classification Search
USPC ..... 340/5.7; 713/186, 182; 726/5
See application file for complete search history.

(56) References Cited

U.S. PATENT DOCUMENTS

| | | | | |
|---|---|---|---|---|
| 8,205,790 | B2 * | 6/2012 | Pennella | G06F 21/31 235/375 |
| 8,424,061 | B2 * | 4/2013 | Rosenoer | G06F 17/30569 380/241 |
| 8,572,391 | B2 * | 10/2013 | Golan | G06F 21/40 705/72 |
| 2003/0061166 | A1 | 3/2003 | Saito et al. | |
| 2003/0115142 | A1 | 6/2003 | Brickell et al. | |
| 2005/0097320 | A1 | 5/2005 | Golan et al. | |
| 2007/0011463 | A1 | 1/2007 | Garfinkle | |
| 2008/0066165 | A1 | 3/2008 | Rosenoer | |
| 2008/0226142 | A1 | 9/2008 | Pennella et al. | |
| 2011/0162033 | A1 | 6/2011 | Feinstein et al. | |

OTHER PUBLICATIONS

Minami, K et al. "Scalability in a secure distributed proof system", Pervasive Computing, Lecture Notes in Computer Science, vol. 3968, 2006, pp. 220-237.

Mostefaoui, G., "Towards a conceptual and software framework for integrating context-based security in pervasive environments", Thesis presented at the University of Fribourg (Switzerland), 2004.

Baldauf, M. et al. "Survey on context-aware systems", Int. J. Ad Hoc and Ubiquitous Computing, vol. 2, No. 4, 2007.

http://www.cisco.com/en/US/products/ps12521/index.html.

* cited by examiner

CONTROLLING ACCESS TO A RESOURCE

CROSS-REFERENCE TO PRIOR APPLICATIONS

This application is the U.S. National Phase application under 35 U.S.C. §371 of International Application No. PCT/EP2014/051790, filed on Jan. 30, 2014, which claims the benefit of European Patent Application No. 13155057.6, filed on Feb. 13, 2013. These applications are hereby incorporated by reference herein.

FIELD OF THE INVENTION

The invention relates to a system and a method for controlling access to a resource. The invention further relates to a computer program product comprising instructions for causing a processor system to perform said method.

BACKGROUND OF THE INVENTION

It is widely known to control access to a resource. For example, access to a physical resource, such as, e.g., a storage cabinet, may be subject to a user having a physical key which fits a lock of the storage cabinet. Hence, the access is controlled in that it is subject to a security measure in the form of a physical key being required to unlock the lock.

Alternatively or additionally to using physical keys, such access may also be controlled electronically, i.e., using an electronic system. Such a system may require a user to identify him/herself, e.g., by entering a user identification on a keypad of the system or by swiping a magnetic badge through a badge reader. Having identified the user, the system may then grant the user access to the resource based on the user passing one or more security measures. For example, the user may be required to enter a password via the keypad. The identification and passing of the one or more security measures may also be combined. For example, the system may obtain a biometric identification of the user, with the providing of the biometric identification also serving as passing a security measure.

US 2005/0097320 A1 describes a flexible transaction processing system. It is said that the flexible transaction processing system may assess a risk level, and based on the risk level, set or alter a level of authentication for the transaction. Several examples are provided of how the risk level may be assessed, including evaluating the transaction, assessing a size of the transaction and assessing the risk level of the user.

It is known to dynamically adjust a level of security needed for accessing an electronic health record of a patient based on a context of the access.

A publication from Pravin Shetty and Seng Loke, titled "*Modelling Context-Aware Security for Electronic Health Records Using Contextual Graphs*", 2007, Australia, describes an approach to modeling security for electronic health records by using contextual graphs. It is said that contextual information may be used in implementing security policies, thereby enabling to take different security actions based on the contextual information. The publication describes such contextual information being, e.g., a role of the user within a medical institution and whether access to the electronic health record is local or remote.

SUMMARY OF THE INVENTION

A problem of dynamically adjusting the level of security based on the described contextual information is that this provides an insufficiently optimal adjustment.

It would be advantageous to provide a system or method for controlling access to a resource which provides a better dynamic adjusting of the level of security.

To better address this concern, a first aspect of the invention provides a system for controlling access to a resource, the access being restricted by an access mechanism, the system comprising:

- an identification subsystem for receiving identification data, the identification data being indicative of a user;
- an access control subsystem for i) subjecting the user to one or more security measures based on use of a security input system, and ii) signaling the access mechanism to grant the user access to the resource based on the user passing the one or more security measures; and
- a task interface for accessing task data, the task data being indicative of a task to be completed by the user;
- wherein the access control subsystem is arranged for determining the one or more security measures based on the task to establish different levels of security depending on the task.

In a further aspect of the invention, a workstation, imaging apparatus or mobile device is provided comprising the system set forth.

In a further aspect of the invention, a method is provided of controlling access to a resource, the access being restricted by an access mechanism, the method comprising:

- receiving identification data, the identification data being indicative of a user;
- subjecting the user to one or more security measures based on use of a security input system;
- signaling the access mechanism to grant the user access to the resource based on the user passing the one or more security measures;
- accessing task data, the task data being indicative of a task to be completed by the user; and
- determining the one or more security measures based on the task to establish different levels of security depending on the task.

In a further aspect of the invention, a computer program product is provided comprising instructions for causing a processor system to perform the method set forth.

The aforementioned measures provide controlled access to a resource such as a physical resource or a virtual resource, e.g., a computer readable file. The access to the resource is normally restricted by an access mechanism, e.g., a physical or virtual lock. For obtaining said access, an identification subsystem is provided for enabling the user to make him/herself known to the system, i.e., to identify him/herself. Furthermore, an access control subsystem is provided which is enabled to grant access to the resource by signaling the access mechanism, e.g., so as to cause an unlocking of the access mechanism. The access control subsystem provides said access to the resource conditionally, namely subject to the user passing one or more security measures. Here, the term security measure refers to a measure which establishes or contributes to a level of security required for obtaining the access to the resource. For example, a security measure may be an authentication measure such as the user needing to provide a general or user-specific password, a biometric identification, unlock a physical lock, etc. For passing said security measures, the user makes use of a security input system which is communicatively arranged with the access control subsystem. The security input system may comprise, e.g., keypad, a biometric sensor, etc.

The one or more security measures are determined by the access control subsystem in that they may be selected from a plurality of security measures, a configuration of one or more pre-selected security measures may be adjusted, etc. Effectively, the access control subsystem determines which security measures need to be passed in order to access the resource, thereby determining the level of security of accessing the resource. As such, the access control subsystem may vary the security measures in number, type, stringency, etc.

The access control subsystem determines the one or more security measures based on a task which is to be completed by the user. For example, the task may be scheduled to be completed by the user at a time/date when accessing the resource, i.e., be a currently or future scheduled task. The task may also have been selected by the user, constitute an ad-hoc task, etc. For obtaining said task, task data is accessed which is at least indicative of said task, in that it may provide a name, identification number, description, etc., of the task. Hence, the task is obtainable in a computer readable form. The task data is accessed via a task interface, and may thus be located externally from the system, e.g., on an external database or external server. The access control subsystem uses the information provided by the task to determine the one or more security measures to be passed by the user to gain access to the resource.

The above measures have the effect that the system determines the level of security for accessing a resource based on a task which is to be completed by the user. The inventors have recognized that such a task is highly suitable for determining the number, type, stringency, etc., of the one or more security measures since a clear relation is expected to exist between the resource and the task. By basing the level of security of the task, this relation is taken directly into account. Even in case such a relation is lacking, i.e., the resource and the task are unrelated, this lack of relation can also be advantageously used to adjust the level of security. Advantageously, a better adjusting of the level of security is obtained in that it is dynamically adjusted to the task to be completed by the user.

Optionally, the access control subsystem is arranged for i) estimating a relevance of the resource to the task based on the task data, and ii) determining the one or more security measures based on said relevance. The task may explicitly or implicitly indicate which resources are needed for carrying out the task. For example, if the task data identifies the task being a medical task of "Check dietary information" and the resource is medical equipment such as Magnetic Resonance Imaging (MRI) system, the access control subsystem may estimate that the resource is not of relevance to the task. Said estimating may be based on, e.g., pre-defined rules, reasoning engines, etc. As such, the relevance of the resource to the task is obtained and subsequently used to determine the one or more security measures, i.e., the level of security. Advantageously, the relevance of the resource to the task may be inversely proportionately applied to the level of security, in that a high relevance yields a low level of security and a low relevance yields a high level of security. As such, resources which are of relevance to the task are easily accessible to the user, i.e., involve few and/or lenient security measures, whereas resources which are of little relevance to said task are difficult to access, i.e., involve many and/or stringent security measures.

Optionally, the task data comprises an agenda of the user, and the access control subsystem is arranged for i) estimating an occurrence frequency of the task based on the agenda, and ii) determining the one or more security measures based on the occurrence frequency. The occurrence frequency of the task is used to determine the one or more security measures. The above measures may be advantageously used to establish a low level of security for frequently occurring tasks and a high level of security for infrequently occurring tasks. The inventors have recognized that tasks which are frequently occurring in an agenda typically involve resources with which the user is well acquainted and typically trusted. Advantageously, the user is enabled to carry out frequently occurring tasks while being less hindered by having to pass the one or more security measures.

Optionally, the task interface is arranged for accessing user data indicative of a role of the user, and the access control subsystem is arranged for determining the one or more security measures based on further input provided by the role of the user. The role of the user allows further improving the determining of the level of security. The task interface accesses the user data which allows the access control subsystem to determine or estimate the role of the user and use said role to determine the one or more security measures. The above measures may be advantageously used to establish a low level of security for users which have a role which is typically associated with the resource. For example, if a nurse wishes to access dietary information of a patient, a low level of security may be applied since nurses are typically associated with such information. The above measures may also be advantageously used to establish a high level of security for users which do not have a role with is typically associated with the resources. For example, if the nurse wishes to access a history of the vital signs of the patient, a high level of security may be applied since doctors rather than nurse are typically associated with such a history.

Optionally, the system further comprises a location determining subsystem for determining a location of the user and/or the resource, and the access control subsystem is arranged for determining the one or more security measures based on further input provided by said location. The location of the user and/or the resource allows further improving the determining of the level of security. The system further comprises a location determining subsystem for determining a location of the user and/or the resource. For example, near field communication (NFC) sensors in a hospital may be used to determine a location of a health care professional carrying an NFC-equipped badge. Other known means of determining the location may also be applied. The resource may be located, e.g., using a location database. For example, the location of the resource may be relatively static and be comprised in the location database. The access control subsystem uses the location of the user and/or the resource to determine the one or more security measures. For example, if the user is a health care professional is located outside of the hospital, a higher level of security may be applied than when the health care professional is located inside of the hospital.

Optionally, the access control subsystem is arranged for i) estimating a consistency between the task and the further input, and ii) determining the one or more security measures based on said consistency. The access control subsystem thus determines if the task is consistent with further input in the form of the role of the user, the location of the user and/or the location of the resource. The consistency is then used to improve the determining of the one or more security measures, e.g., in that high consistency may indicate a non-suspect situation and thus may yield a low level of security, whereas a low consistency may indicate a suspect situation and thus may yield a high level of security. Here, the term consistency refers to a logical agreement, e.g., whether or not the task is logically associated with the role of the user.

Optionally, the task interface is arranged for receiving a notification being indicative of an interrupting task having a higher priority than the first mentioned task of the user, and the access control subsystem is arranged for determining the one or more security measures based on the interrupting task instead of the first mentioned task. The system is thus enabled to be notified of an interrupting task which has a higher priority than the first mentioned task. After being notified of said interrupting task, the access control subsystem determines the one or more security measures based on the interrupting task instead of the first mentioned task. Advantageously, the system is enabled to adapt to sudden and unexpected changes in the task to be completed by the user. Advantageously, in case the system also provides communication means to the user, e.g., if the system is constituted by or comprised in a mobile device, an incoming communication to the user, e.g., an e-mail or other type of message, may serve as the notification to the user as well as to the system.

Optionally, the notification is indicative of a further user associated with the interrupting task, and the access control subsystem is arranged for determining the one or more security measures further based on a role and/or a location of the further user. For example, if the further user has a role which is typically associated with the resource, a low level of security may be applied. A more specific example may be that if the user is a nurse and the further user is a doctor, a low level of security which is normally associated with the doctor may be applied to granting the nurse access to the resource.

Optionally, the interrupting task is an emergency task. The system is thus enabled to automatically adapt the level of security to an emergency task. The above measures may be advantageously used to establish a low level of security in case of an emergency task, or to temporarily disable the security measures all together.

Optionally, the resource is a medical resource.

Optionally, the medical resource is constituted by at least one of: patient information, medication, and medical equipment.

Optionally, the task is a scheduled task. Optionally, the task is scheduled for the current time and/or for the immediate future, i.e., is a current or future scheduled task.

It will be appreciated by those skilled in the art that two or more of the above-mentioned embodiments, implementations, and/or aspects of the invention may be combined in any way deemed useful.

Modifications and variations of the workstation, the imaging apparatus, the mobile device, the method, and/or the computer program product, which correspond to the described modifications and variations of the system, can be carried out by a person skilled in the art on the basis of the present description.

The invention is defined in the independent claims. Advantageous yet optional embodiments are defined in the dependent claims.

BRIEF DESCRIPTION OF THE DRAWINGS

These and other aspects of the invention are apparent from and will be elucidated with reference to the embodiments described hereinafter. In the drawings.

It should be noted that items which have the same reference numbers in different Figures, have the same structural features and the same functions, or are the same signals. Where the function and/or structure of such an item has been explained, there is no necessity for repeated explanation thereof in the detailed description.

DETAILED DESCRIPTION OF EMBODIMENTS

Figure 1:
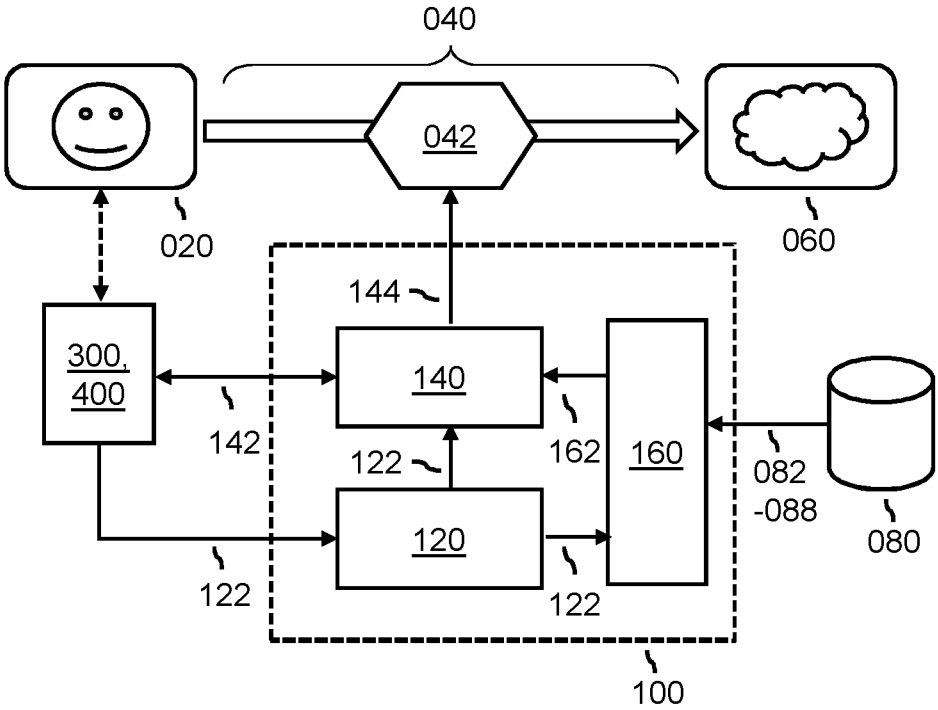
FIG. 1 shows a system for controlling access to a resource.

FIG. 1 shows a system 100 for controlling access 040 to a resource 060, the access being restricted by an access mechanism 042. The system 100 comprises an identification subsystem 120 arranged for receiving identification data 122, the identification data being indicative of a user 020. The system 100 further comprises an access control subsystem 140 arranged for subjecting the user 020 to one or more security measures based on use of a security input system 300, 400. For that purpose, the access control subsystem 140 is shown to be connected to the security input system 300, 400. The access control subsystem 140 is further arranged for signaling the access mechanism 042 to grant the user 020 access 040 to the resource 060. For that purpose, the access control subsystem 140 is shown to be connected to the access mechanism 042. The system 100 further comprises a task interface 160 arranged for accessing task data 082, the task data being indicative of a task 162 to be completed by the user 020. FIG. 1 shows the task interface 160 accessing the task data 082, by way of example, on an external database 080. The access control subsystem 140 is further arranged for determining the one or more security measures based on the task 162. For that purpose, the access control subsystem 140 is shown to, by way of example, receive the task 162 from the task interface 160, i.e., in a computer readable form. Alternatively or additionally, the access control subsystem 140 may receive the task data 082 itself from the task interface 160 and then determine the task 162 from the task data.

An operation of the system 100 may be briefly explained as follows. The identification subsystem 120 receives the identification data 122. The task interface 160 accesses the task data 082. The access control subsystem 140 determines one or more security measures based on the task 062. For example, the access control subsystem 140 may semantically or otherwise analyze the task 062, match the task 062 to a pre-defined rule, etc., in order to determine the one or more security measures. The access control subsystem 140 subjects the user 020 to the one or more security measures based on use of the security input system. Upon passing the one or more security measures, the access control subsystem 140 signals the access mechanism 042 to grant the user 020 access 040 to the resource 060.

Figure 2:
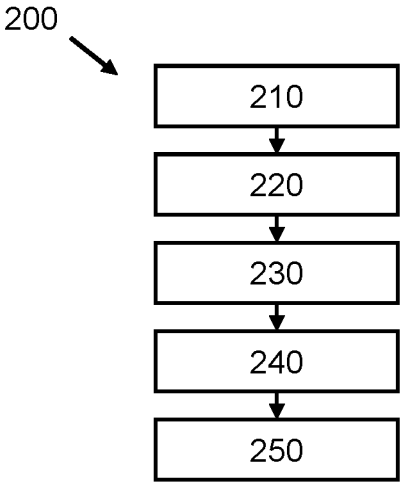
FIG. 2 shows a method for controlling access to a resource.

FIG. 2 shows a method 200 of controlling access to a resource, with the access being restricted by an access mechanism. The method 200 may correspond to an operation of the system 100. However, the method 200 may also be performed in separation of the system 100, e.g., using a different system or device. The method 200 comprises, in a step titled "RECEIVING IDENTIFICATION DATA", receiving 210 identification data, the identification data being indicative of a user. The method 200 further comprises, in a step titled "SUBJECTING USER TO SECURITY MEASURES", subjecting 240 the user to one or more security measures based on use of a security input system. The method 200 further comprises, in a step titled "GRANTING USER ACCESS", signaling 250 the access mechanism to grant the user access to the resource based on the user passing the one or more security measures. The method 200 further comprises, before the subjecting 240, a step titled "ACCESSING TASK DATA", comprising accessing 220 task data, the task data being indicative of a task to be completed by the user, and a step titled "DETERMINING SECURITY MEASURES", comprising determining 230 the one or more security measures based on the task to establish different levels of security depending on the task. It is noted that the above steps may be performed in any suitable order. For example, the steps of receiving 210 identification data and accessing 220 task data may be may be performed simultaneously or in a different order, e.g., in a reverse order.

Figure 3:
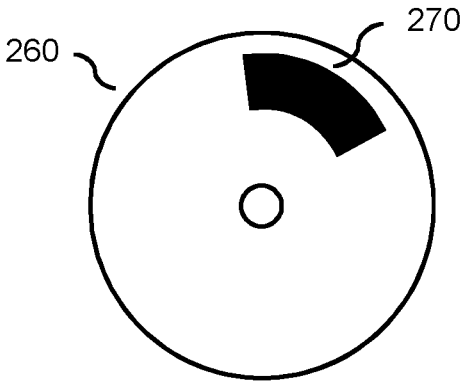
FIG. 3 shows a computer program product for performing the method.

FIG. 3 shows a computer program product 270 comprising instructions for causing a processor system to perform the aforementioned method 200. The computer program product 270 may be comprised on a computer readable medium 260, for example in the form of as a series of machine readable physical marks and/or as a series of elements having different electrical, e.g., magnetic, or optical properties or values.

The system 100 and its operation may be explained in more detail as follows.

The identification subsystem 120 receives identification data 122. The identification data 122 may be obtained using any suitable identification technique, as known per se from, e.g., the field of identification of human individuals. For example, the user 020 may provide the identification data 122 by entering a user identifier via a keypad. The user may also provide the identification data 122 without being actively involved. For example, facial recognition may be used to identify the user 020 in a video image provided by a video camera. Another example is that Radio Frequency Identification (RFID) sensors may be employed to sense a user identifier stored in a RFID tag embedded in a user's badge. In the example of FIG. 1, the identification subsystem 120 is shown to receive the identification data 122 from the security input system 300, 400. As such, the identification data may be provided as part of passing the one or more security measures, i.e., in an implicit manner. However, the identification data may also be provided explicitly, i.e., in a separate step. It is noted that, in general, the identification data 122 may be obtained from any suitable source.

The access 040 to the resource 060 is restricted by the access mechanism 042. The access mechanism 042 may be, e.g., a physical lock or a virtual equivalent of a physical lock. The access control subsystem 140 is shown to be connected to the access mechanism 042 for enabling sending an access signal 144 to the access mechanism 042. It is noted that the access mechanism 042 does not need to be part of the system 100. Rather, as shown in FIG. 1, the access mechanism 042 may be an external access mechanism.

The access control subsystem 140 is arranged for granting the user 020 access 040 to the resource 060 conditionally to the user 020 passing one or more security measures. For the latter purpose, the user 020 may make use of a security input system 300, 400 which enables the user 020 to provide input needed for passing the security measures. Said input is shown symbolically in FIG. 1 by a dashed line between the user 020 and the security input system 300, 400, and may involve the user 020 providing a biometric input to a biometric sensor of the security input system 300, 400, entering a password on a keypad of the security input system 300, 400, etc. It will be appreciated that various other security measures may be advantageously used in addition to, or instead of, the aforementioned biometric-based and password-based security measures. Such other security measures are known per se from the fields of, e.g., computer security and physical security. The security input system 300, 400 is shown to be connected to the access control subsystem 140 to allow an exchange of security data 142 with the access control subsystem 140. As such, the access control subsystem 140 is enabled to obtain the input of the user 020 to the one or more security measures.

The access control subsystem 140 is further arranged for determining the one or more security measures. Here, the term determining refers to the access control subsystem 140 selecting or configuring the one or more security measures so as to provide different levels of security based on the task. For that purpose, although not shown in FIG. 1, the system 100 may make use of different types of security input systems 300, 400.

The task interface 160 is arranged for accessing the task data 082, for example, on an external database 080. The task data is at least indicative of a task 162 to be completed by the user 020. For example, the task data 082 may comprise an agenda of the user 020 which identifies a number of scheduled tasks of the user 020. The task interface 160 and/or the access control subsystem 140 may then establish a scheduled task 162 by looking up a current time and/or current date in the agenda to determine which of the scheduled tasks is scheduled for the current time or soon thereafter. It will be appreciated that the task data 082 may be indicative of the scheduled task 162 in various ways, e.g., by indicating a name, identification code, description, etc., of the scheduled task 162. For example, in case the user 020 is a health care professional such as a nurse, the task data 082 may indicate as scheduled task 162, e.g., "Check patient's condition", "Do general round", "Converse with patients", "Do cleaning", "Log patient's condition", "Accompany doctor on round", "Serve meal", "Provide medication", etc. It is noted that the task data 082 may not need to comprise an agenda of the user 020. For example, the task data 082 may comprise a number of tasks, and the user 020 may need to indicate which one of the tasks he/she is going to perform. Another example is that a planning office may provide task data 082 directly indicating the task 162.

The access control subsystem 140 is arranged for determining the one or more security measures based on the task 162. For example, the access control subsystem 140 may analyze the task using a reasoning engine to determine the one or more security measures, match the task to one or more pre-defined rules to determine the one or more security measures, etc. The one or more security measures may also be determined based on the task 162 as described below. It is noted that such options may also be advantageously combined.

The access control subsystem 140 may be arranged for estimating a relevance of the resource 060 to the task 162 based on the task data 082. Accordingly, the access control subsystem 140 may determine the one or more security measures based on said relevance. For estimating the relevance, known techniques may be used such as pre-defined rules, reasoning engines, etc. For example, if the resource 060 is medical equipment such as a Magnetic Resonance Imaging (MRI) system and the task 162 has been determined to be "Serve meal", the access control subsystem 140 may determine one or more security measures which define a high level of security. Accordingly, the user 020 may need to pass stringent and/or a large number of security measures in order to access the MRI system. Similarly, if the resource 060 is dietary information of a patient while the task 162 is "Serve meal", the access control subsystem 140 may determine one or more security measures which define a low level of security. Accordingly, the user 020 may need to pass little or no security measures in order to access the dietary information.

The task 162 may not always be sufficiently suitable to estimate said relevance to the resource. Accordingly, the task interface 160 may be arranged for accessing a task description 088 of the task 162, and the access control subsystem 140 may be arranged for estimating the relevance of the resource 060 based on the task description 088. The task description 088 may be obtained from, e.g., medical guidelines, medical protocols, role definitions, responsibility definitions, etc.

In cases where the task data 082 comprises an agenda of the user 020, the access control subsystem 140 may be arranged for estimating an occurrence frequency of the task based on the agenda. Accordingly, the access control subsystem 140 may determine the one or more security measures based on the occurrence frequency. Estimating an occurrence frequency may involve counting the occurrence of tasks which are identical to the task. Alternatively, similar tasks may also be considered.

In order to further improve the determining of the one or more security measures, the task interface 160 may be arranged for accessing user data 084 indicative of a role of the user 020. In addition, the access control subsystem 140 may be arranged for determining the one or more security measures based on further input provided by the role of the user. Additionally or alternatively, the system 100 may comprising a location determining subsystem 180 for determining a location of the user 020 and/or the resource 060, and the access control subsystem 140 may be arranged for determining the one or more security measures based on further input provided by said location. This aspect will be further described with reference to FIG. 4. The access control subsystem 140 may also be arranged for estimating a consistency between the task 162 and the further input, and for determining the one or more security measures based on said consistency. Said estimating may be based on known techniques such as pre-defined rules, reasoning engines, etc.

The level of security may further be dynamically adjusted based on a notification which is indicative of an interrupting task having a higher priority than the first mentioned task, such as an emergency task. For that purpose, the task interface 160 may be arranged for receiving such a notification, and the access control subsystem 140 may be arranged for determining the one or more security measures based on the interrupting task instead of the first mentioned task 162. The notification 086 may be additionally indicative of a further user associated with the interrupting task. In such a case, the access control subsystem 140 may be arranged for determining the one or more security measures further based on a role and/or a location of the further user. The system 100 may thus be used to disable or lower the level of security when it is notified of an emergency task. A particular example may be the following. The system 100 may be used for communication, e.g., it may allow the user being called. The system 100 may access a list of phone numbers of the phones which are used in emergency situations. Whenever a call through the system 100 involves one of these phone numbers, the level of security for accessing the resource 060 may be lowered or disabled. In general, the system 100 may provide communication services for the user, and may be arranged for being notified of an emergency task via said services.

It is noted that, although not shown in FIG. 1, the access mechanism 042 may control access to multiple resources, and the access control subsystem 140 may be arranged for signaling the access mechanisms 042 to grant the user 020 access 040 to one or more of the multiple resources. Additionally or alternatively, there may be multiple access mechanisms which each control access to one or more resources, and the access control subsystem 140 may be arranged for signaling one or more of the multiple access mechanisms to grant the user 020 access 040 to a respective resource. Such an access control subsystem 140 may be used to grant the user 020 access 040 to multiple resources simultaneously, without a need for the user 020 to pass security measures for each one of the resources 060 individually. For example, the user 020 may be automatically granted access to each resource associated with the task 162 when passing the one or more security measures.

Figure 4:
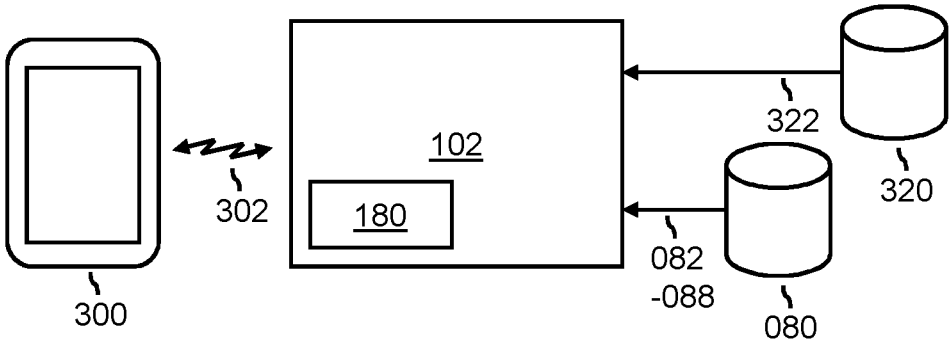
FIG. 4 shows the system controlling access to a computer-readable resource.

FIG. 4 shows a system 102 for controlling access to a computer-readable resource 322. The system 102 may be identical to the system 100 described with reference to FIG. 1 except for the following differences. In the example of FIG. 4, a mobile device 300 is shown which is connectable to the system 102, e.g., via a wireless signal 302. The mobile device 300 may be a Smartphone, a tablet, etc. The user may desire to use the mobile device 300 to access computer-readable data 322 on a further database 320. For example, the user may desire to use the mobile device 300 to access patient information 322 on the further database 320. The system 102 may be arranged for controlling the access to the patient information 322. In this example, the system 102 may comprise the access mechanism in that, if access is granted to the patient information 322, the system 102 itself may provide the patient information 322 to the mobile device 300. However, this is not a limitation.

In the example of FIG. 4, the mobile device may be used as security input device 300, in that the user may use the mobile device 300 to pass the one or more security measures determined by the access control subsystem 140. For example, the user may use the mobile device 300 to respond to a security question provided by the access control subsystem 140. Moreover, the mobile device 300 may provide the identification data 122 to the identification subsystem 120. The identification data 122 may be provided by means of an answer to a security question, i.e., answering the security question also serves as identification of the user. Additionally or alternatively, the identification data 122 may also be provided separately from passing the one or more security measures.

The system 102 comprises a location determining subsystem 180 for determining a location of the user 020 and/or of the resource 060. The mobile device 300 may comprise the system 100. In such a case, the location determining subsystem 180 may be constituted by location sensors of the mobile device 300, e.g., GPS, near-field sensors or wireless networking sensors. Moreover, a video camera of the mobile device 300 may be used to identify the user 020, identify a location of the mobile device 300, etc. The video camera may also be used to estimate the task 162 based on an activity shown in a view video camera. Essentially, the video camera may serve as the task interface 160.

Figure 5:
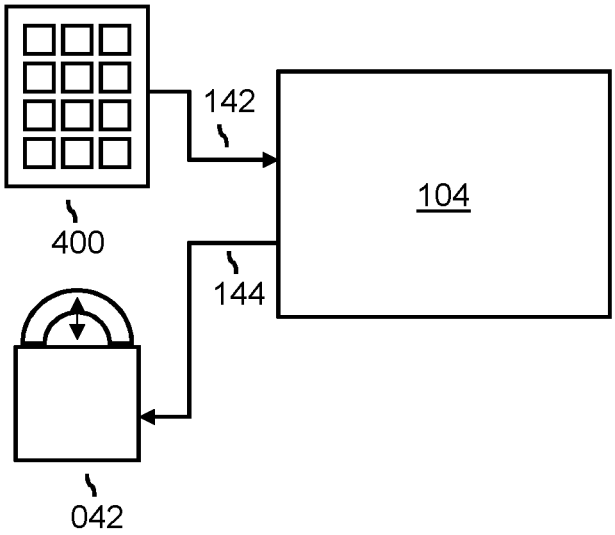
FIG. 5 shows the system controlling access to a physical resource.

FIG. 5 shows a system 104 for controlling access to a physical resource. The system 104 may be identical to the system 100 described with reference to FIG. 1 except for the following differences. In the example of FIG. 5, a keypad 400 is provided as the security input device 400. As such, the user 020 may need to pass the one or more security measures by operating the keypad 400, e.g., by typing in a code, password or passphrase. In this example, the access mechanism 042 is a physical lock which is electronically controlled by the system 104 via an access signal 144. The physical lock provides access to a physical resource. Accordingly, if the user 020 passes the one or more security measures, the system 104 may cause the physical resource to be unlocked by providing the access signal 144 to the physical lock 042. An example of a physical resource may be, e.g., a cabinet or room.

It will be appreciated that the present invention may be advantageously used in a healthcare environment, e.g., to control access to resources such as patient information, medication or medical equipment. In particular, present invention may be used to control access to an application running on a mobile device used in the healthcare environment. However, this is not a limitation in that the invention may be equally used in other environments, such as, e.g., offices, banks, airports, etc., and in separation of a mobile device.

It will be appreciated that the present invention may be advantageously used to provide a dynamic level of security when accessing a resource. The system determines one or more security measures so as to establish the level of security. Said determining is based on a task to be completed by a user. The determining may further be based on, e.g., a role and responsibility of the user, an urgency and priority of the task, whether the task is a scheduled or ad-hoc task, types of medical devices around the user, personnel that the user is working with, a role of the personnel around the user, presence of patients nearby the user, etc.

The level of security may be that of a user login of an application on a mobile device, in that the user may need to pass the one or more security measures in order to access the application. Moreover, the application running on the mobile device may vary its user interface and/or the visualization of information and/or the depth of the visualized information based on the user, the task and possibly further obtained contextual information. In general, a very low level of security may be established when there is incoming or outgoing call on the mobile device to/from an emergency department. A low level of security may be established when the resource accessed via the mobile device is patient related, the user and the patient share the same location, and the resource accessed via the mobile device is relevant to the task, the user's role and the user's location, i.e., all of the above information is consistent with each other. A high level of security may be established when the earlier mentioned information is clearly inconsistent with each other. A high level of security may also be established when the user is outside of a certain area, e.g., the healthcare environment. In other cases, a normal level of security may be established.

It will be appreciated that the invention also applies to computer programs, particularly computer programs on or in a carrier, adapted to put the invention into practice. The program may be in the form of a source code, an object code, a code intermediate source and an object code such as in a partially compiled form, or in any other form suitable for use in the implementation of the method according to the invention. It will also be appreciated that such a program may have many different architectural designs. For example, a program code implementing the functionality of the method or system according to the invention may be sub-divided into one or more sub-routines. Many different ways of distributing the functionality among these sub-routines will be apparent to the skilled person. The sub-routines may be stored together in one executable file to form a self-contained program. Such an executable file may comprise computer-executable instructions, for example, processor instructions and/or interpreter instructions (e.g. Java interpreter instructions). Alternatively, one or more or all of the sub-routines may be stored in at least one external library file and linked with a main program either statically or dynamically, e.g. at run-time. The main program contains at least one call to at least one of the sub-routines. The sub-routines may also comprise function calls to each other. An embodiment relating to a computer program product comprises computer-executable instructions corresponding to each processing step of at least one of the methods set forth herein. These instructions may be sub-divided into sub-routines and/or stored in one or more files that may be linked statically or dynamically. Another embodiment relating to a computer program product comprises computer-executable instructions corresponding to each means of at least one of the systems and/or products set forth herein. These instructions may be sub-divided into sub-routines and/or stored in one or more files that may be linked statically or dynamically.

The carrier of a computer program may be any entity or device capable of carrying the program. For example, the carrier may include a storage medium, such as a ROM, for example, a CD ROM or a semiconductor ROM, or a magnetic recording medium, for example, a hard disk. Furthermore, the carrier may be a transmissible carrier such as an electric or optical signal, which may be conveyed via electric or optical cable or by radio or other means. When the program is embodied in such a signal, the carrier may be constituted by such a cable or other device or means. Alternatively, the carrier may be an integrated circuit in which the program is embedded, the integrated circuit being adapted to perform, or used in the performance of, the relevant method.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A system for controlling access to a resource by signaling an access mechanism which restricts access to the resource, the system comprising:

an identification subsystem for receiving identification data, the identification data being indicative of a user;

an access control subsystem for i) subjecting the user to one or more security measures based on use of a security input system, and ii) signaling the access mechanism to grant the user access to the resource based on the user passing the one or more security measures; and a task interface for accessing task data, the task data being indicative of a scheduled task of the user;

wherein the access control subsystem is arranged for determining the one or more security measures based on the scheduled task to establish different levels of security depending on the scheduled task.

2. The system according to claim 1, wherein the access control subsystem is arranged for i) estimating a relevance of the resource to the scheduled task based on the task data, and ii) determining the one or more security measures based on said relevance.

3. The system according to claim 1, wherein the task data comprises an agenda of the user, and wherein the access control subsystem is arranged for i) estimating an occurrence frequency of the scheduled task based on the agenda, and ii) determining the one or more security measures based on the occurrence frequency.

4. The system according to claim 1, wherein the task interface is arranged for accessing user data indicative of a role of the user, and wherein the access control subsystem is arranged for determining the one or more security measures based on further input provided by the role of the user.

5. The system according to claim 1, further comprising a location determining subsystem for determining a location of the user and/or the resource, and wherein the access control subsystem is arranged for determining the one or more security measures based on further input provided by said location.

6. The system according to claim 4, wherein the access control subsystem is arranged for estimating a consistency between the scheduled task and the further input, and ii) determining the one or more security measures based on said consistency.

7. The system according to claim 1, wherein the task interface is arranged for receiving a notification being indicative of an interrupting task having a higher priority than the scheduled task of the user, and wherein the access control subsystem is arranged for determining the one or more security measures based on the interrupting task instead of the scheduled task.

8. The system according to claim 7, wherein the notification is indicative of a further user associated with the interrupting task, and wherein the access control subsystem is arranged for determining the one or more security measures further based on a role and/or a location of the further user.

9. The system according to claim 7, wherein the interrupting task is an emergency task.

10. The system according to claim 1, wherein the resource is a medical resource.

11. The system according to claim 10, wherein the medical resource is constituted by at least one of: patient information, medication, and medical equipment.

12. A workstation or imaging apparatus comprising the system of claim 1.

13. A mobile device comprising the system of claim 1.

14. A method of controlling access to a resource by signaling an access mechanism which restricts access to the resource, the method comprising:

receiving identification data, the identification data being indicative of a user;

subjecting the user to one or more security measures based on use of a security input system;

signaling the access mechanism to grant the user access to the resource based on the user passing the one or more security measures;

accessing task data, the task data being indicative of a scheduled task of the user; and determining the one or more security measures based on the scheduled task to establish different levels of security depending on the scheduled task.

15. A computer program product comprising instructions for causing a processor system to perform the method according to claim 14.

* * * * *